US006656671B1

(12) United States Patent
Aylward et al.

(10) Patent No.: US 6,656,671 B1
(45) Date of Patent: Dec. 2, 2003

(54) PHOTOGRAPHIC ELEMENT WITH VOIDED CUSHIONING LAYER

(75) Inventors: Peter T. Aylward, Hilton, NY (US); Robert P. Bourdelais, Pittsford, NY (US); Thaddeus S. Gula, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/197,729

(22) Filed: Nov. 20, 1998

(51) Int. Cl.[7] ..... G03C 1/79

(52) U.S. Cl. ..... 430/531; 430/533; 430/536; 430/538

(58) Field of Search ..... 430/531, 533, 430/536, 538

(56) References Cited

U.S. PATENT DOCUMENTS

| | | | | |
|---|---|---|---|---|
| 4,377,616 A | * | 3/1983 | Ashcraft et al. | 428/213 |
| 4,661,401 A | * | 4/1987 | Akao | 428/215 |
| 4,778,782 A | | 10/1988 | Ito et al. | |
| 4,971,950 A | | 11/1990 | Kato et al. | |
| 5,310,639 A | * | 5/1994 | Lushington et al. | 430/539 |
| 5,356,853 A | | 10/1994 | Ueno et al. | |
| 5,466,519 A | | 11/1995 | Shirakura et al. | |
| 5,514,460 A | | 5/1996 | Surman et al. | |
| 5,674,672 A | * | 10/1997 | Kawamoto | 430/533 |
| 5,853,965 A | | 12/1998 | Haydock et al. | |
| 5,866,282 A | | 2/1999 | Bourdelais et al. | |
| 5,874,205 A | | 2/1999 | Bourdelais et al. | |
| 5,888,643 A | * | 3/1999 | Aylward et al. | 430/536 |
| 6,165,938 A | * | 12/2000 | Narita et al. | 503/227 |
| 6,348,304 B1 | * | 2/2002 | Gula et al. | 430/496 |
| 6,447,976 B1 | * | 9/2002 | Dontula et al. | 430/201 |
| 6,514,659 B1 | * | 2/2003 | Dontula et al. | 430/201 |
| 6,537,656 B1 | * | 3/2003 | Dontula et al. | 428/314.4 |

FOREIGN PATENT DOCUMENTS

| | | |
|---|---|---|
| EP | 0 540 020 A | 5/1993 |
| EP | 0 656 264 A | 6/1995 |
| EP | 0 880 065 A1 | 11/1998 |
| EP | 0 880 067 A1 | 11/1998 |
| EP | 0 880 069 A1 | 11/1998 |
| EP | 0 926 548 A | 6/1999 |
| GB | 2 325 749 A | 12/1998 |
| GB | 2 325 750 A | 12/1998 |

* cited by examiner

*Primary Examiner*—Janet Baxter
*Assistant Examiner*—Amanda C. Walke
(74) *Attorney, Agent, or Firm*—Paul A. Leipold

(57) ABSTRACT

This invention relates to a photographic element comprising at least one silver halide containing imaging layer and a cushioning layer below said at least one imaging layer having a compression percentage of between 5 and 25%.

15 Claims, No Drawings

PHOTOGRAPHIC ELEMENT WITH VOIDED CUSHIONING LAYER

FIELD OF THE INVENTION

This invention relates to photographic materials. In the preferred form it relates to base materials for photographic prints.

BACKGROUND OF THE INVENTION

In the formation of color paper it is known that the base paper has applied thereto a layer of polymer, typically polyethylene. This layer serves to provide waterproofing to the paper, as well as providing a smooth surface on which the photosensitive layers are formed. While the polyethylene does provide waterproofing to the paper, the melt extruded polyethylene layer used in color paper has very little dimensional strength and, as a result, cannot be used alone as a carrier of an image. It has been proposed in U.S. Pat. No. 5,244,861 to utilize biaxially oriented polypropylene in receiver sheets for thermal dye transfer. In U.S. Pat. No. 5,244,861 high strength biaxially oriented sheets are laminated to cellulose paper with low density polyethylene. The biaxially oriented sheet utilized in U.S. Pat. No. 5,244,861 is an efficient thermal dye transfer support for the thermal dye receiving layers. The materials disclosed in U.S. Pat. No. 5,244,861 for use as thermal dye receiving layers are not sensitive to compressive forces.

In prior art photographic papers, great care needs to be taken in handling the materials prior to exposure and development of the image. Prior art silver halide photographic papers are sensitive to compressive forces. If sufficient force is applied to the photosensitive layers, an unacceptable latent site on the silver grain may be created. Compressive forces are typically applied during the slitting of sensitized rolls of photographic paper and during photographic processing of images. If this occurs, an area of the photosensitive layer may actually form dye coupler density in an area that, under normal circumstances, would not form density. It would be desirable to have a photographic base material that has a degree of compressibility, thus cushioning the pressure sensitive photographic layers. This will provide a photographic base material that has increased resistance to force that may be applied to it prior to exposure and development.

Problem to Be Solved by the Invention

There is a continuing need for photographic base materials that have resistance to compressive load prior to exposure that results in fewer defects in the print after development.

SUMMARY OF THE INVENTION

It is an object of the invention to provide photographic elements having improved resistance to compressive loads.

It is another object to provide photographic elements with reduced yellow discoloration caused by compressive loads prior to development.

It is a further object to provide photographic elements that have improved resistance to defects caused by winding. These and other objects of the invention are accomplished by a photographic element comprising at least one silver halide containing imaging layer and a cushioning layer below said at least one imaging layer having a compression percentage of between 5 and 25%.

Advantageous Effect of the Invention

The invention provides photographic print elements having improved resistance to defects caused by compressive loads applied to said elements prior to their development.

DETAILED DESCRIPTION OF THE INVENTION

The invention has numerous advantages over prior practices in the art. The invention provides photographic elements that have less yellow edge, an imperfection caused by emulsion compression during slitting of photographic paper. The elements of the invention also are resistant to defects caused by compression during winding. During winding relatively small defects and variations in thickness of photographic base will become magnified and create ridges, gauge bands, and hard spots that result in compression of silver halide layers causing defects after development. The photographic elements of the invention have a cushioning layer below the silver halide and will not suffer from these defects, as the cushioning layer will compress during winding, thereby relieving strain on silver halide grains which will result in defects. Further, the cushioned elements of the invention will rebound somewhat after compression during winding or contact with compressive forces during processing, thereby resulting in a flat surface of the photographic element even after compression has been applied in winding or processing. The flat surface will, therefore, present a pleasing image in the product without undesirable surface streaks or discoloration caused by damage to silver halide grains which results in undesirable image errors.

Because silver halide grains tend to be pressure sensitive, the selection of grain size has been limited by the compressive forces that occur during manufacturing and photographic processing. By providing a compressive layer just below the pressure sensitive emulsion, pressure sensitive silver grain designs that perform better for printing speed and image sharpness can now be utilized because the compressive forces are absorbed by the support. These and other advantages will be apparent from the detailed description below.

The terms as used herein, "top", "upper", "emulsion side", and "face" mean the side or towards the side of an imaging member bearing the imaging layers. The terms "bottom", "lower side", and "back" mean the side or towards the side of the imaging member opposite from the side bearing the imaging layers or developed image. The term "tie layer" as used herein refers to a layer of material that is used to adhere biaxially oriented sheets to a base such as paper, polyester, fabric, or other suitable material for the viewing of images.

As used herein, the term "compression percentage" is defined as the percent that a material deforms under a load referenced to when there is no compressive load applied. Compressive percentage is measured by using an "optical" thickness reading vs. a high pressure caliper reading. The optical thickness is obtained by slicing the photographic element with a microtome to expose the thickness dimension perpendicular to a microscope suitable for making uncompressed thickness readings. A high pressure caliper is hereby defined as a device to measure the thickness, as it is compressed between two pads with an area of 0.317 $cm^2$ and a pressure of at least 70 newtons/$cm^2$. The compression percentage is 1 minus the ratio of the high pressure caliper to the optical thickness.

As used herein, the term "recovery" is defined as the optical thickness of a material after the compressive load is removed. The recovery of a material after being subjected to a compressive load is related to the magnitude of the compressive load, the type of material, the elastic limit of the material, the humidity and temperature of the materials, and the dynamics of the compressive load. The recovery percentage is 1 minus the ratio of the optical thickness after the compressive load has been removed to the optical thickness before the compressive load has been applied. The compressive load used to determine recovery percentage is 1.0 MPa.

The cushioning layers of the invention have levels of voiding adjusted to provide optimum compression. When a sufficiently large compressive load is applied to unexposed prior art photographic paper, an undesirable latent image can form significantly reducing the commercial value of the image. It is well known in the field of silver halide imaging that silver emulsions tend to be pressure sensitive. By providing a voided layer, the compressive forces applied to the materials of the invention are relieved by the voided layer, reducing the undesirable formation of a latent image. An imaging layer having a compression percentage of between 5 to 25% has been found to eliminate unwanted latent image formation during manufacturing and photographic processing of images. Compression percentage less than 4% does not significantly improve pressure sensitivity of silver halide imaging layers. Compression percentage greater than 30% has been found to stress fracture, creating undesirable fracture lines in the image. It has been found that after the compressive load has been removed, the cushioning layer must partially recover so that undesirable permanent depressions in the image are reduced. Suitable recovery percentage is between 50% and 100%. A recovery percentage less than 40% will result in an undesirable permanent depression in the image. The most preferred recovery percentage is greater than 90%. A 90% recovery of the cushioning layer is not perceptually significant to consumers.

In addition to reducing the pressure sensitivity of the silver halide image forming layers, the compression of the voided layer also reduces the impact of the lack of support thickness uniformity. A lack of uniformity can be caused by lamination ridges, protrusions, or hard spots. Prior art polyethylene coated photographic paper support does not have a voided layer; thus, a lack of uniformity causes manufacturing waste as the lack of uniformity causes unwanted latent image formation and can create unacceptable impression in the roll. By locating a voided layer just below the emulsion, the inherent lack of uniformity created during manufacturing is accommodated by the voided layer.

An example of compressive loads commonly applied to photographic paper is the load applied in converting sensitized rolls to smaller rolls used in photographic printing process. When a photographic element is subjected to a compression force, such as that created with a slitter knife with a rake angle of less than 20 degrees, there is a compressive shear force that concentrates in the emulsion layer. Such a force, acting at the edge of the cut, can then cause the silver halide grains to develop a site on the grain that, when developed, leaves an undesired visual defect. The cushioned layer, as incorporated in this invention, allows the compressive forces to be applied over a larger footprint, therefore reducing the pressure on the silver grains and significantly reducing the tendency for the grains to develop pressure sensitive imperfections. It is important that the cushioning layer undergoes an elastic deformation and has sufficient resilience to rebound or recover from the applied load.

Since the polyolefin layer contains particles to help form the voids during orientation, the layer is not solid, there are limits to the point load that can be applied, and rebounding is still present. The cushioning layer is a polymeric layer containing voids and in the preferred method is an oriented polyolefin sheet which is adhered to the photographic base by an adhesive. The preferred location of said biaxially oriented voided polyolefin sheet is under the photographic emulsion and on top of the photographic base substrate. This location is preferred because the voided oriented sheet is most effective when the cushioning layer is located between the base substrate and the emulsion. In this situation the force being applied to the emulsion can be more effectively dissipated. It is also possible to either add a second cushioning layer to the bottom side of a photographic element or to use the backside location as the sole cushion layer.

Nonuniformities in the thickness of the polyolefin layers, whether they are extrusion coated directly or laminated to a base substrate, can cause hard streaks or ridges. As there may be a thousand laps of these nonuniform layers wound on top of each other, high spots are developed and pressure is built up in localized areas. In some cases, it is possible to cause pressure sensitive imperfections in these areas. The cushioning effect of these layers can help spread the force load caused by this situation. The presence of at least one biaxially oriented voided layer is needed to provide the desired enhancement to pressure sensitivity. Additional improvements may be realized with additional layers on the same side or in combination on the top and bottom sides of the base substrate. Since the act of voiding a polymeric layer usually entails the addition of a particle or non-compatible polymer to the base polymer and then orienting in at least one direction, it may be necessary to add a skin layer to one or more side of the voided polymeric sheet. The addition of the skin layer adds strength to the voided sheet to improve its handling characteristics during said sheet orientation process. A skin layer comprising polyethylene adds additional functionality to the voided sheet structure. This greatly enhances the photographic emulsion adhesion to the biaxially oriented sheet when said polyethylene layer is located between the emulsion and the cushioned layer. The solid skin layer also provides holdout of the emulsion from the holes in the cushioning layer.

The photographic element containing a biaxially oriented voided polyolefin sheet is normally adhered to a paper base by a lamination process. The preferred embodiment of this invention uses a melt extrudable polyolefin polymer to adhere the sheet to the paper base. Melt extrudable polyolefin polymers are used because of their relative low cost, stability, chemical inertness, and general ease of handling. Depending on the end use of the photographic element, it may be desirable to use a polyester base substrate in place of paper. In this case, a laminated cushion layer is critical because the polyester base has little or no compressibility in the thickness direction, and there is a greater need to have a force reducing layer to minimize pressure induced imperfections.

The sensitivity of a photographic emulsion layer containing silver halide may be impacted by a variety of parameters such as silver grain size, the ratio of silver grains to binder, as well as the addition of chemical addenda. In the case of this invention the silver halide layer comprises an emulsion having an average grain size greater than 0.30 $\mu$m. In general, the larger the grain size, the more intolerant the pressure sensitivity of the emulsion. The grain size is important to the image quality, as the probability that a grain will absorb a quantum from a given exposure is proportional to the grain volume. The granularity of the developed image is also dependent on the size of the silver halide grains.

In addition to voided biaxially oriented polymer sheets, the cushioning layer may be formed by the incorporation of solid particles or non-compatible polymer within the base resin and then oriented in at least one direction. Cushioned layer may also be formed be chemical or physical blowing agents. Typical material comprises one or more from the list of azodicarbonamide, zeolite or molecular sieves, gases such as nitrogen, carbon dioxide, or liquids that turn to gas at atmospheric pressure. Microcellular polymer may be created by saturation of the polymer with a gas such as nitrogen, carbon dioxide, or other gas to achieve a bubble density in the range of 0.05 to 5 billion/$cm^3$. It is desirable to balance the density of foam to solid phase polymer. Excessive bubble density will alter the mechanical properties of the polymer sheet. Such properties as tensile yield, modulus, compressibility, mechanical stress cracking, and others are impacted. Annealing the sheet provides some beneficial impact to the mechanical properties. Advantages to a microcellular foamed sheet or layer in the case when it is coextruded with other solid or filled layers enhance opacity, sharpness, cushioning, and overall whiteness of the structure. The mircocellular foam layer may be coextruded with other solid layers that are either clear or filled with pigment, tinting, and optical brightening materials to achieve end photographic property. A preferred embodiment would comprise an upper surface of a solid polymer such as a polyolefin. This layer may further comprise tinting pigments or dyes to offset any color imparted to the final photographic print. Directly under this layer is another polymer layer that is most preferably a polyolefin or polyester comprising a white pigment. Suitable white pigments may be $TiO_2$, $BaSO_4$, clay, ZnS, talc, and others known in the art. Said pigment loading may be between 4–60% by weight of that layer. Thickness of said layer may also be varied to achieve the desired optical properties. Directly under this layer is a layer of microcellular foamed polymer. Such a layer may comprises any suitable polymer such as polyolefin and their copolymers, polyester, polystyrene, and others that has been supersaturated with a gas such that as it is heated to the optimal temperature, that microcellular foam is generated within that polymer layer. Said structure would further comprise a solid layer of polymer on the backside or side next to the support substrate. This structure may be coextruded directly onto the support substrate or may be formed, oriented, and annealed as a separate polymer sheet that is then laminated to a support utilizing an adhesive. Such a structure is able to develop good mechanical properties, excellent optical properties, as well as having excellent cushioning and compressibility properties to prevent pressure sensitivity issues such as yellow edge with photographic emulsions. Such a structure will also provide excellent cushioning for the thermal dye transfer process for generating near photographic image quality. The compressibility of the microcellular layer allows the dye donor ribbon and the image receiving layer to develop intimate contact, as well as to provide a degree of thermal insulation to assure complete transfer of dye to the desired area of the receiver. Such a compressible layer will allow the use of slightly rougher supports without loss of dye transfer. Furthermore, it enhances the speed at which the dyes may be transferred to the receiver.

Another means to achieve a good cushioning layer for pressure sensitive emulsions to prevent yellow edge is to generate pores using a chemical blowing agent. A blowing agent is any material which yields an insoluble gas in a polymer matrix under conditions for extrusion. Two of the preferred blowing agents are azodicarbonamide and sodium bicarbonate. Azodicarbonamide exothermially forms nitrogen and carbon dioxide. The microcellular foam structure is produced by the decomposition of the chemical blowing agent. The gas dissolves in the molten polymer because of the high pressure in the extruder. It is important to optimize the foam nucleation at the point of exiting the die. The drop in pressure causes the gas to become super-saturated. Once the polymer is chilled rapidly, the foam bubbles freeze into the polymer as its viscosity increases. This technique is sensitive to processing conditions within the extruder, as well as the rheological properties of the polymer. The most preferable means is to combine the chemical blowing agent within a polymer in combination with coextrusion of other layers to provide enhanced adhesion of the photographic or imaging layer to the topmost polymer layer. Furthermore, layers of polymer may also be coextruded that comprise pigment, tinting, or optical brightening materials. The addition of these materials is critical to providing an element that has optimal whiteness, sharpness, and opacity. It may also be necessary to add processing aid to enhance the foaming process, as well as the compatibility of the other polymer layers during extrusion. Materials such as antioxidants, slip agents, filler, ultraviolet screening, and others may be necessary.

Any suitable biaxially oriented voided polyolefin sheet may be used for the sheet on the top side of the laminated base used in the invention. Microvoided composite biaxially oriented sheets are preferred and are conveniently manufactured by coextrusion of the core and surface layers, followed by biaxial orientation, whereby voids are formed around void-initiating material contained in the core layer. Such composite sheets may be formed as in U.S. Pat. Nos. 4,377,616; 4,758,462; and 4,632,869.

The core of the preferred composite sheet should be from 15 to 95% of the total thickness of the sheet, preferably from 30 to 85% of the total thickness. The nonvoided skin(s) should thus be from 5 to 85% of the sheet, preferably from 15 to 70% of the thickness.

The density (specific gravity) of the composite sheet, expressed in terms of "percent of solid density" is calculated as follows:

$$\frac{\text{Composite Sheet Density}}{\text{Polymer Density}} \times 100 = \%\ \text{of Solid Density}$$

Percent solid density should be between 45% and 100%, preferably between 67% and 100%. As the percent solid density becomes less than 67%, the composite sheet becomes less manufacturable due to a drop in tensile strength and it becomes more susceptible to physical damage.

The total thickness of the composite sheet can range from 12 to 100 $\mu$m, preferably from 20 to 70 $\mu$m. Below 20 $\mu$m, the microvoided sheets may not be thick enough to minimize any inherent non-planarity in the support and would be more difficult to manufacture. At thickness higher than 70 $\mu$m, little improvement in either surface smoothness or mechanical properties are seen, and so there is little justification for the further increase in cost for extra materials.

The biaxially oriented sheets of the invention preferably have a water vapor permeability that is less than $0.85\times10^{-5}$ g/$mm^2$/day. This allows faster emulsion hardening, as the laminated support of this invention greatly slows the rate of water vapor transmission from the emulsion layers during coating of the emulsions on the support. The transmission rate is measured by ASTM F1249.

"Void" is used herein to mean devoid of added solid and liquid matter, although it is likely the "voids" contain gas. The void-initiating particles which remain in the finished packaging sheet core should be from 0.1 to 10 $\mu$m in diameter, preferably round in shape, to produce voids of the desired shape and size. The size of the void is also dependent on the degree of orientation in the machine and transverse directions. Ideally, the void would assume a shape which is defined by two opposed and edge contacting concave disks. In other words, the voids tend to have a lens-like or biconvex shape. The voids are oriented so that the two major dimensions are aligned with the machine and transverse directions of the sheet. The Z-direction axis is a minor dimension and is roughly the size of the cross diameter of the voiding particle. The voids generally tend to be closed cells, and thus there is virtually no path open from one side of the voided-core to the other side through which gas or liquid can traverse.

The void-initiating material may be selected from a variety of materials, and should be present in an amount of about 5 to 50% by weight. based on the weight of the core matrix polymer. Preferably, the void-initiating material comprises a polymeric material. When a polymeric material is used, it may be a polymer that can be melt-mixed with the polymer from which the core matrix is made and be able to form dispersed spherical particles as the suspension is cooled down. Examples of this would include nylon dispersed in polypropylene, polybutylene terephthalate in polypropylene, or polypropylene dispersed in polyethylene terephthalate. If the polymer is preshaped and blended into the matrix polymer, the important characteristic is the size and shape of the particles. Spheres are preferred and they can be hollow or solid. These spheres may be made from cross-linked polymers which are members selected from the group consisting of an alkenyl aromatic compound having the general formula $Ar—C(R)=CH_2$, wherein Ar represents an aromatic hydrocarbon radical, or an aromatic halohydrocarbon radical of the benzene series and R is hydrogen or the methyl radical; acrylate-type monomers include monomers of the formula $CH_2=C(R')—C(O)(OR)$ wherein R is selected from the group consisting of hydrogen and an alkyl radical containing from about 1 to 12 carbon atoms and R' is selected from the group consisting of hydrogen and methyl; copolymers of vinyl chloride and vinylidene chloride, acrylonitrile and vinyl chloride, vinyl bromide, vinyl esters having formula $CH_2=CH(O)COR$, wherein R is an alkyl radical containing from 2 to 18 carbon atoms; acrylic acid, methacrylic acid, itaconic acid, citraconic acid, maleic acid, fumaric acid, oleic acid, vinylbenzoic acid; the synthetic polyester resins which are prepared by reacting terephthalic acid and dialkyl terephthalics or ester-forming derivatives thereof, with a glycol of the series $HO(CH_2)_nOH$ wherein n is a whole number within the range of 2–10 and having reactive olefinic linkages within the polymer molecule, the above-described polyesters which include copolymerized therein up to 20 percent by weight of a second acid or ester thereof having reactive olefinic unsaturation and mixtures thereof, and a cross-linking agent selected from the group consisting of divinylbenzene, diethylene glycol dimethacrylate, diallyl fumarate, diallyl phthalate, and mixtures thereof.

Examples of typical monomers for making the void initiating cross-linked polymer include styrene, butyl acrylate, acrylamide, acrylonitrile, methyl methacrylate, ethylene glycol dimethacrylate, vinyl pyridine, vinyl acetate, methyl acrylate, vinylbenzyl chloride, vinylidene chloride, acrylic acid, divinylbenzene, acrylamidomethyl-propane sulfonic acid, vinyl toluene, etc. Preferably, the cross-linked polymer is polystyrene or poly(methyl methacrylate). Most preferably, it is polystyrene and the cross-linking agent is divinylbenzene.

Processes well known in the art yield nonuniformly sized particles, characterized by broad particle size distributions. The resulting beads can be classified by screening the beads spanning the range of the original distribution of sizes. Other processes such as suspension polymerization and limited coalescence directly yield very uniformly sized particles.

The void-initiating materials may be coated with agents to facilitate voiding. Suitable agents or lubricants include colloidal silica, colloidal alumina, and metal oxides such as tin oxide and aluminum oxide. The preferred agents are colloidal silica and alumina, most preferably, silica. The cross-linked polymer having a coating of an agent may be prepared by procedures well known in the art. For example, conventional suspension polymerization processes wherein the agent is added to the suspension is preferred. As the agent, colloidal silica is preferred.

The void-initiating particles can also be inorganic spheres, including solid or hollow glass spheres, metal or ceramic beads or inorganic particles such as clay, talc, barium sulfate, and calcium carbonate. The important thing is that the material does not chemically react with the core matrix polymer to cause one or more of the following problems: (a) alteration of the crystallization kinetics of the matrix polymer, making it difficult to orient, (b) destruction of the core matrix polymer, (c) destruction of the void-initiating particles, (d) adhesion of the void-initiating particles to the matrix polymer, or (e) generation of undesirable reaction products, such as toxic or high color moieties. The void-initiating material should not be photographically active or degrade the performance of the photographic element in which the biaxially oriented polyolefin sheet is utilized.

For the biaxially oriented sheet on the top side toward the emulsion, suitable classes of thermoplastic polymers for the biaxially oriented sheet and the core matrix-polymer of the preferred composite sheet comprise polyolefins.

Suitable polyolefins include polypropylene, polyethylene, polymethylpentene, polystyrene, polybutylene, and mixtures thereof. Polyolefin copolymers, including copolymers of propylene and ethylene such as hexene, butene, and octene are also useful. Polypropylene is preferred, as it is low in cost and has desirable strength properties.

The nonvoided skin layers of the composite sheet can be made of the same polymeric materials as listed above for the core matrix. The composite sheet can be made with skin(s) of the same polymeric material as the core matrix, or it can be made with skin(s) of different polymeric composition than the core matrix. For compatibility, an auxiliary layer can be used to promote adhesion of the skin layer to the core.

Addenda may be added to the core matrix and/or to the skins to improve the whiteness of these sheets. This would include any process which is known in the art including adding a white pigment, such as titanium dioxide, barium sulfate, clay, or calcium carbonate. This would also include adding fluorescing agents which absorb energy in the UV region and emit light largely in the blue region, or other additives which would improve the physical properties of the sheet or the manufacturability of the sheet. For photographic use, a white base with a slight bluish tint is preferred.

The coextrusion, quenching, orienting, and heat setting of these composite sheets may be effected by any process which is known in the art for producing oriented sheet, such as by a flat sheet process or a bubble or tubular process. The flat sheet process involves extruding the blend through a slit die and rapidly quenching the extruded web upon a chilled casting drum so that the core matrix polymer component of the sheet and the skin components(s) are quenched below their glass solidification temperature. The quenched sheet is then biaxially oriented by stretching in mutually perpendicular directions at a temperature above the glass transition temperature, below the melting temperature of the matrix polymers. The sheet may be stretched in one direction and then in a second direction or may be simultaneously stretched in both directions. After the sheet has been stretched, it is heat set by heating to a temperature sufficient to crystallize or anneal the polymers while restraining to some degree the sheet against retraction in both directions of stretching.

The composite sheet, while described as having preferably at least three layers of a microvoided core and a skin layer on each side, may also be provided with additional layers that may serve to change the properties of the biaxially oriented sheet. A different effect may be achieved by additional layers. Such layers might contain tints, antistatic materials, or different void-making materials to produce sheets of unique properties. Biaxially oriented sheets could be formed with surface layers that would provide an improved adhesion, or look to the support and photographic element. The biaxially oriented extrusion could be carried out with as many as 10 or more layers if desired to achieve some particular desired property.

These composite sheets may be coated or treated after the coextrusion and orienting process or between casting and full orientation with any number of coatings which may be used to improve the properties of the sheets including printability, to provide a vapor barrier, to make them heat sealable, or to improve the adhesion to the support or to the photosensitive layers. Examples of this would be acrylic coatings for printability and coating polyvinylidene chloride for heat seal properties. Further examples include flame, plasma, or corona discharge treatment to improve printability or adhesion.

By having at least one nonvoided skin on the microvoided core, the tensile strength of the sheet is increased and makes it more manufacturable. It allows the sheets to be made at wider widths and higher draw ratios than when sheets are made with all layers voided. Coextruding the layers further simplifies the manufacturing process.

The structure of a preferred biaxially oriented sheet of the invention where the imaging layers are coated on the polyethylene skin layer is as follows:

| |
|---|
| Polyethylene exposed surface layer with blue tint |
| Polypropylene layer containing 24% anatase $TiO_2$ and optical brightener |
| Polypropylene microvoided layer with 20% compression percentage |
| Polypropylene layer with 18% rutile $TiO_2$ |
| Polypropylene bottom layer |

The sheet on the side of the base paper opposite to the emulsion layers may be any suitable sheet. The sheet may or may not be microvoided. It may have the same composition as the sheet on the top side of the paper backing material. Biaxially oriented sheets are conveniently manufactured by coextrusion of the sheet, which may contain several layers, followed by biaxial orientation. Such biaxially oriented sheets are disclosed in, for example, U.S. Pat. No. 4,764,425 the disclosure of which is incorporated by reference.

The preferred biaxially oriented sheet is a biaxially oriented polyolefin sheet, most preferably a sheet of polyethylene or polypropylene. The thickness of the biaxially oriented sheet should be from 10 to 150 $\mu$m. Below 15 $\mu$m, the sheets may not be thick enough to minimize any inherent non-planarity in the support and would be more difficult to manufacture. At thicknesses higher than 70 $\mu$m, little improvement in either surface smoothness or mechanical properties are seen, and so there is little justification for the further increase in cost for extra materials.

Suitable classes of thermoplastic polymers for the biaxially oriented sheet include polyolefins, polyesters, polyamides, polycarbonates, cellulosic esters, polystyrene, polyvinyl resins, polysulfonamides, polyethers, polyimides, polyvinylidene fluoride, polyurethanes, polyphenylenesulfides, polytetrafluoroethylene, polyacetals, polysulfonates, polyester ionomers, and polyolefin ionomers. Copolymers and/or mixtures of these polymers can be used.

Suitable polyolefins include polypropylene, polyethylene, polymethylpentene, and mixtures thereof. Polyolefin copolymers, including copolymers of propylene and ethylene such as hexene, butene and octene are also useful. Polypropylenes are preferred because they are low in cost and have good strength and surface properties.

Suitable polyesters include those produced from aromatic, aliphatic or cycloaliphatic dicarboxylic acids of 4–20 carbon atoms, and aliphatic or alicyclic glycols having from 2–24 carbon atoms. Examples of suitable dicarboxylic acids include terephthalic, isophthalic, phthalic, naphthalene dicarboxylic acid, succinic, glutaric, adipic, azelaic, sebacic, fumaric, maleic, itaconic, 1,4-cyclohexanedicarboxylic, sodiosulfoisophthalic, and mixtures thereof. Examples of suitable glycols include ethylene glycol, propylene glycol, butanediol, pentanediol, hexanediol, 1,4-cyclohexanedimethanol, diethylene glycol, other polyethylene glycols, and mixtures thereof. Such polyesters are well known in the art and may be produced by well-known techniques, e.g., those described in U.S. Pat. Nos. 2,465,319 and 2,901,466. Preferred continuous matrix polyesters are those having repeat units from terephthalic acid or naphthalene dicarboxylic acid and at least one glycol selected from ethylene glycol, 1,4-butanediol and 1,4-cyclohexanedimethanol. Poly(ethylene terephthalate), which may be modified by small amounts of other monomers, is especially preferred. Other suitable polyesters include liquid crystal copolyesters formed by combination with a suitable amount of a co-acid component such as stilbene dicarboxylic acid. Examples of such liquid crystal copolyesters are those disclosed in U.S. Pat. Nos. 4,420,607; 4,459,402; and 4,468,510.

Useful polyamides include nylon 6, nylon 66, and mixtures thereof. Copolymers of polyamides are also suitable continuous phase polymers. An example of a useful polycarbonate is bisphenol-A polycarbonate. Cellulosic esters suitable for use as the continuous phase polymer of the composite sheets include cellulose nitrate, cellulose triacetate, cellulose diacetate, cellulose acetate propionate, cellulose acetate butyrate, and mixtures or copolymers thereof. Useful polyvinyl resins include polyvinyl chloride, poly(vinyl acetal), and mixtures thereof. Copolymers of vinyl resins can also be utilized.

The biaxially oriented sheet on the backside of the laminated base can be made with layers of the same polymeric material, or it can be made with layers of different polymeric composition. For compatibility, an auxiliary layer can be used to promote adhesion of multiple layers.

Addenda may be added to the biaxially oriented backside sheet to improve the whiteness of these sheets. This would include any process which is known in the art including adding a white pigment, such as titanium dioxide, barium sulfate, clay, or calcium carbonate. This would also include adding fluorescing agents which absorb energy in the UV region and emit light largely in the blue region, or other additives which would improve the physical properties of the sheet or the manufacturability of the sheet.

The coextrusion, quenching, orienting, and heat setting of these biaxially oriented sheets may be effected by any process which is known in the art for producing an oriented sheet, such as by a flat sheet process or a bubble or tubular process. The flat sheet process involves extruding or coextruding the blend through a slit die and rapidly quenching the extruded or coextruded web upon a chilled casting drum so that the polymer component(s) of the sheet are quenched below their solidification temperature. The quenched sheet is then biaxially oriented by stretching in mutually perpendicular directions at a temperature above the glass transition temperature of the polymer(s). The sheet may be stretched in one direction and then in a second direction or may be simultaneously stretched in both directions. After the sheet has been stretched, it is heat set by heating to a temperature sufficient to crystallize the polymers, while restraining to some degree the sheet against retraction in both directions of stretching.

The biaxially oriented sheet on the backside of the laminated base, while described as having preferably at least one layer, may also be provided with additional layers that may serve to change the properties of the biaxially oriented sheet. A different effect may be achieved by additional layers. Such layers might contain tints, antistatic materials, or slip agents to produce sheets of unique properties. Biaxially oriented sheets could be formed with surface layers that would provide an improved adhesion, or look to the support and photographic element. The biaxially oriented extrusion could be carried out with as many as 10 layers if desired to achieve some particular desired property.

These biaxially oriented sheets may be coated or treated after the coextrusion and orienting process or between casting and full orientation with any number of coatings which may be used to improve the properties of the sheets including printability, to provide a vapor barrier, to make them heat sealable, or to improve the adhesion to the support or to the photosensitive layers. Examples of this would be acrylic coatings for printability, coating polyvinylidene chloride for heat seal properties. Further examples include flame, plasma, or corona discharge treatment to improve printability or adhesion.

The structure of a preferred backside biaxially oriented sheet of this invention wherein styrene butadiene methacrylate coated layer is on the bottom of the photographic element is as follows:

| |
|---|
| Solid polyester core |
| Copolymer of polyethylene and a terpolymer of ethylene, propylene and butylene |
| Styrene butadiene methacrylate coating |

The support to which the microvoided composite sheets and biaxially oriented sheets are laminated for the laminated support of the photosensitive silver halide layer may be a polymeric, a synthetic paper, cloth, woven polymer fibers or a cellulose fiber paper support, or laminates thereof. The base also may be a microvoided polyethylene terephalate such as disclosed in U.S. Pat. Nos. 4,912,333; 4,994,312; and 5,055,371.

The preferred support is a photographic grade cellulose fiber paper. When using a cellulose fiber paper support, it is preferable to extrusion laminate the microvoided composite sheets to the base paper using a polyolefin resin. Extrusion laminating is carried out by bringing together the biaxially oriented sheets of the invention and the base paper with application of an adhesive between them, followed by their being pressed in a nip such as between two rollers. The adhesive may be applied to either the biaxially oriented sheets or the base paper prior to their being brought into the nip. In a preferred form the adhesive is applied into the nip simultaneously with the biaxially oriented sheets and the base paper. The adhesive may be any suitable material that does not have a harmful effect upon the photographic element. A preferred material is polyethylene that is melted at the time it is placed into the nip between the paper and the biaxially oriented sheet.

During the lamination process, it is desirable to maintain control of the tension of the biaxially oriented sheets in order to minimize curl in the resulting laminated support. For high humidity applications (>50% RH) and low humidity applications (<20% RH), it is desirable to laminate both a front side and backside film to keep curl to a minimum.

The surface roughness of this invention can also be accomplished by laminating a biaxially oriented sheet to a paper base that has the desired roughness. The roughness of the paper base can be accomplished by any method known in the art such as a heated impression nip or a press felt combined with a roller nip in which the rough surface is part of the press nip. The preferred roughness of the base paper is from 35 $\mu$m to 150 $\mu$m. This preferred range is larger than roughness range for the imaging support because of the loss of roughness that occurs in melt extrusion lamination.

In one preferred embodiment, in order to produce photographic elements with a desirable photographic look and feel, it is preferable to use relatively thick paper supports (e.g., at least 120 mm thick, preferably from 120 to 250 mm thick) and relatively thin microvoided composite sheets (e.g., less than 50 mm thick, preferably from 20 to 50 mm thick, more preferably from 30 to 50 mm thick).

As used herein, the phrase "photographic element" is a material that utilizes photosensitive silver halide in the formation of images. The photographic elements can be black-and-white, single color elements, or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

The photographic emulsions useful for this invention are generally prepared by precipitating silver halide crystals in a colloidal matrix by methods conventional in the art. The colloid is typically a hydrophilic film forming agent such as gelatin, alginic acid, or derivatives thereof.

The crystals formed in the precipitation step are washed and then chemically and spectrally sensitized by adding spectral sensitizing dyes and chemical sensitizers, and by providing a heating step during which the emulsion temperature is raised, typically from 40° C. to 70° C., and maintained for a period of time. The precipitation and spectral and chemical sensitization methods utilized in preparing the emulsions employed in the invention can be those methods known in the art.

Chemical sensitization of the emulsion typically employs sensitizers such as sulfur-containing compounds, e.g., allyl isothiocyanate, sodium thiosulfate and allyl thiourea; reducing agents, e.g., polyamines and stannous salts; noble metal compounds, e.g., gold, platinum; and polymeric agents, e.g., polyalkylene oxides. As described, heat treatment is employed to complete chemical sensitization. Spectral sensitization is effected with a combination of dyes, which are designed for the wavelength range of interest within the visible or infrared spectrum. It is known to add such dyes both before and after heat treatment.

After spectral sensitization, the emulsion is coated on a support. Various coating techniques include dip coating, air knife coating, curtain coating, and extrusion coating.

The silver halide emulsions utilized in this invention may be comprised of any halide distribution. Thus, they may be comprised of silver chloride, silver bromide, silver bromochloride, silver chlorobromide, silver iodochloride, silver iodobromide, silver bromoiodochloride, silver chloroiodobromide, silver iodobromochloride, and silver iodochlorobromide emulsions. It is preferred, however, that the emulsions be predominantly silver chloride emulsions. By predominantly silver chloride, it is meant that the grains of the emulsion are greater than about 50 mole percent silver chloride. Preferably, they are greater than about 90 mole percent silver chloride; and optimally greater than about 95 mole percent silver chloride.

The silver halide emulsions can contain grains of any size and morphology. Thus, the grains may take the form of cubes, octahedrons, cubo-octahedrons, or any of the other naturally occurring morphologies of cubic lattice type silver halide grains. Further, the grains may be irregular such as spherical grains or tabular grains. Grains having a tabular or cubic morphology are preferred.

The photographic elements of the invention may utilize emulsions as described in The Theory of the Photographic Process, Fourth Edition, T. H. James, Macmillan Publishing Company, Inc., 1977, pages 151–152. Reduction sensitization has been known to improve the photographic sensitivity of silver halide emulsions. While reduction sensitized silver halide emulsions generally exhibit good photographic speed, they often suffer from undesirable fog and poor storage stability.

Reduction sensitization can be performed intentionally by adding reduction sensitizers, chemicals which reduce silver ions to form metallic silver atoms, or by providing a reducing environment such as high pH (excess hydroxide ion) and/or low pAg (excess silver ion). During precipitation of a silver halide emulsion, unintentional reduction sensitization can occur when, for example, silver nitrate or alkali solutions are added rapidly or with poor mixing to form emulsion grains. Also, precipitation of silver halide emulsions in the presence of ripeners (grain growth modifiers) such as thioethers, selenoethers, thioureas, or ammonia tends to facilitate reduction sensitization.

Examples of reduction sensitizers and environments which may be used during precipitation or spectral/chemical sensitization to reduction sensitize an emulsion include ascorbic acid derivatives; tin compounds; polyamine compounds; and thiourea dioxide-based compounds described in U.S. Pat. Nos. 2,487,850; 2,512,925; and British Patent 789,823. Specific examples of reduction sensitizers or conditions, such as dimethylamineborane, stannous chloride, hydrazine, high pH (pH 8–11) and low pAg (pAg 1–7) ripening are discussed by S. Collier in Photographic Science and Engineering, 23, 113 (1979). Examples of processes for preparing intentionally reduction sensitized silver halide emulsions are described in EP 0 348 934 A1 (Yamashita), EP 0 369 491 (Yamashita), EP 0 371 388 (Ohashi), EP 0 396 424 A1 (Takada), EP 0 404 142 A1 (Yamada), and EP 0 435 355 A1 (Makino).

The photographic elements of this invention may use emulsions doped with Group VIII metals such as iridium, rhodium, osmium, and iron as described in *Research Disclosure*, Sep. 1994, Item 36544, Section I, published by Kenneth Mason Publications, Ltd., Dudley Annex, 12a North Street, Emsworth, Hampshire PO10 7DQ, ENGLAND. Additionally, a general summary of the use of iridium in the sensitization of silver halide emulsions is contained in Carroll, "Iridium Sensitization: A Literature Review," Photographic Science and Engineering, Vol. 24, No. 6, 1980. A method of manufacturing a silver halide emulsion by chemically sensitizing the emulsion in the presence of an iridium salt and a photographic spectral sensitizing dye is described in U.S. Pat. No. 4,693,965. In some cases, when such dopants are incorporated, emulsions show an increased fresh fog and a lower contrast sensitometric curve when processed in the color reversal E-6 process as described in The British Journal of Photography Annual, 1982, pages 201–203.

A typical multicolor photographic element of the invention comprises the invention laminated support bearing a cyan dye image-forming unit comprising at least one red-sensitive silver halide emulsion layer having associated therewith at least one cyan dye-forming coupler; a magenta image-forming unit comprising at least one green-sensitive silver halide emulsion layer having associated therewith at least one magenta dye-forming coupler; and a yellow dye image-forming unit comprising at least one blue-sensitive silver halide emulsion layer having associated therewith at least one yellow dye-forming coupler. The element may contain additional layers, such as filter layers, interlayers, overcoat layers, subbing layers, and the like. The support of the invention may also be utilized for black-and-white photographic print elements.

The photographic elements may also contain a transparent magnetic recording layer such as a layer containing magnetic particles on the underside of a transparent support, as in U.S. Pat. No. 4,279,945 and 4,302,523. Typically, the element will have a total thickness (excluding the support) of from about 5 to bout 30 $\mu$m.

The invention may be utilized with the materials disclosed in *Research Disclosure*, 40145 of September 1997. The invention is particularly suitable for use with the materials of the color paper examples of sections XVI and XVII. The couplers of section II are also particularly suitable. The Magenta I couplers of section II, particularly M-7, M-10, M-11, and M-18 set forth below are particularly desirable.

M-7

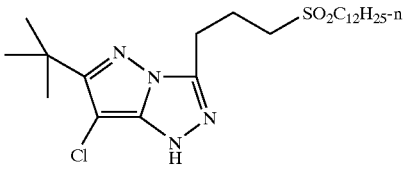

M-10

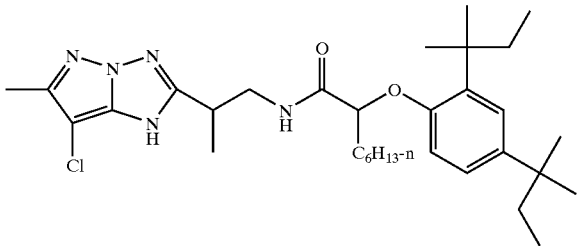

M-11

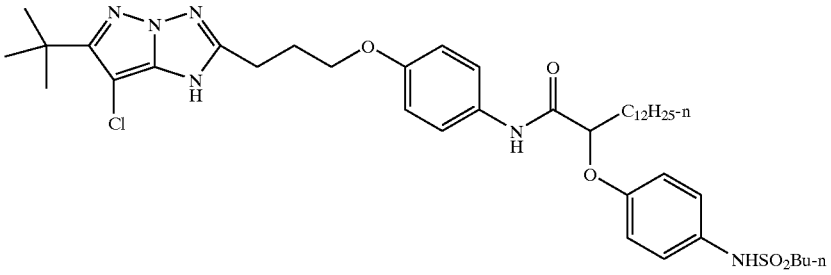

M-18

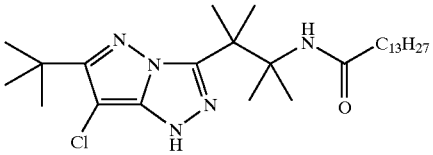

In order to successfully transport display materials of the invention, the reduction of static caused by web transport through manufacturing and image processing is desirable. Since the light sensitive imaging layers of this invention can be fogged by light from a static discharge accumulated by the web as it moves over conveyance equipment such as rollers and drive nips, the reduction of static is necessary to avoid undesirable static fog. The polymer materials of this invention have a marked tendency to accumulate static charge as they contact machine components during transport. The use of an antistatic material to reduce the accumulated charge on the web materials of this invention is desirable. Antistatic materials may be coated on the web materials of this invention and may contain any known materials in the art which can be coated on photographic web materials to reduce static during the transport of photographic paper. Examples of antistatic coatings include conductive salts and colloidal silica. Desirable antistatic properties of the support materials of this invention may also be accomplished by antistatic additives which are an integral part of the polymer layer. Incorporation of additives that migrate to the surface of the polymer to improve electrical conductivity include fatty quaternary ammonium compounds, fatty amines, and phosphate esters. Other types of antistatic additives are hygroscopic compounds such as polyethylene glycols and hydrophobic slip additives that reduce the coefficient of friction of the web materials. An antistatic coating applied to the opposite side of the image layer or incorporated into the backside polymer layer is preferred. The backside is preferred because the majority of the web contact during conveyance in manufacturing and photoprocessing is on the backside. The preferred surface resistivity of the antistat coat at 50% RH is less than $10^{13}$ ohm/square. A surface resistivity of the antistat coat at 50% RH is less than $10^{13}$ ohm/square and has been shown to sufficiently reduce static fog in manufacturing and during photoprocessing of the image layers.

In the following Table, reference will be made to (1) *Research Disclosure*, December 1978, Item 17643, (2) *Research Disclosure*, December 1989, Item 308119, and (3) *Research Disclosure*, September 1996, Item 38957, all published by Kenneth Mason Publications, Ltd., Dudley Annex, 12a North Street, Emsworth, Hampshire PO10 7DQ, ENGLAND. The Table and the references cited in the Table are to be read as describing particular components suitable for use in the elements of the invention. The Table and its cited references also describe suitable ways of preparing, exposing, processing and manipulating the elements, and the images contained therein.

| Reference | Section | Subject Matter |
|---|---|---|
| 1 | I, II | Grain composition, |
| 2 | I, II, IX, X, XI, XII, XIV, XV | morphology and preparation. Emulsion preparation including hardeners, coating |
| 3 | I, II, III, IX A & B | aids, addenda, etc. |
| 1 | III, IV | Chemical sensitization and |
| 2 | III, IV | spectral sensitization/ |
| 3 | IV, V | desensitization |
| 1 | V | UV dyes, optical brighteners, |
| 2 | V | luminescent dyes |
| 3 | VI | |
| 1 | VI | Antifoggants and stabilizers |
| 2 | VI | |
| 3 | VII | |
| 1 | VIII | Absorbing and scattering |
| 2 | VIII, XIII, XVI | materials; Antistatic layers; matting agents |
| 3 | VIII, IX C & D | |
| 1 | VII | Image-couplers and image- |
| 2 | VII | modifying couplers; Dye |

-continued

| Reference | Section | Subject Matter |
|---|---|---|
| 3 | X | stabilizers and hue modifiers |
| 1 | XVII | Supports |
| 2 | XVII | |
| 3 | XV | |
| 3 | XI | Specific layer arrangements |
| 3 | XII, XIII | Negative working emulsions; Direct positive emulsions |
| 2 | XVIII | Exposure |
| 3 | XVI | |
| 1 | XIX, XX | Chemical processing; |
| 2 | XIX, XX, XXII | Developing agents |
| 3 | XVIII, XIX, XX | |
| 3 | XIV | Scanning and digital processing procedures |

The photographic elements can be exposed with various forms of energy which encompass the ulrtaviolet, visible, and infrared regions of the electromagnetic spectrum, as well as with electron beam, beta radiation, gamma radiation, X ray, alpha particle, neutron radiation, and other forms of corpuscular and wavelike radiant energy in either noncoherent (random phase) forms or coherent (in phase) forms, as produced by lasers. When the photographic elements are intended to be exposed by X rays, they can include features found in conventional radiographic elements.

The photographic elements are preferably exposed to actinic radiation, typically in the visible region of the spectrum, to form a latent image, and then processed to form a visible image, preferably by other than heat treatment. Processing is preferably carried out in the known RA-4™ (Eastman Kodak Company) Process or other processing systems suitable for developing high chloride emulsions.

The following examples illustrate the practice of this invention. They are not intended to be exhaustive of all possible variations of the invention. Parts and percentages are by weight unless otherwise indicated.

EXAMPLES

In this example, a biaxially oriented, microvoided polyolefin sheet was laminated to a photographic grade cellulose paper base and was coated with a typical light sensitive silver halide emulsion (sample 2). The microvoided polyolefin sheet used in the invention contained a voided layer with a compression percentage of 25%. The invention was compared to a commercially available silver halide photographic paper utilizing polyethylene coated paper as a support (sample 1). This example will show the significant improvement in compression percentage over prior art photographic paper. Further, this example will show a significant reduction in undesirable latent image formation when a compressive load is applied to the unexposed silver halide image layers. Finally, several manufacturing advantages resulting from a support with a 25% compression percentage will be obvious. Photographic grade paper utilized in both the invention and control:

A photographic paper support was produced by refining a pulp furnish of 50% bleached hardwood kraft, 25% bleached hardwood sulfite, and 25% bleached softwood sulfite through a double disk refiner, then a Jordan conical refiner to a Canadian Standard Freeness of 200 cc. To the resulting pulp furnish was added 0.2% alkyl ketene dimer, 1.0% cationic cornstarch, 0.5% polyamide-epichlorohydrin, 0.26 anionic polyacrylamide, and 5.0% $TiO_2$ on a dry weight basis. A base paper of about 46.5 lbs. per 1000 sq. ft. (ksf) bone dry weight was made on a fourdrinier paper machine, wet pressed to a solid of 42%, and dried to a moisture of 10% using steam-heated dryers achieving a Sheffield Porosity of 160 Sheffield Units and an apparent density 0.70 g/cc. The paper base was then surface sized using a vertical size press with a 10% hydroxyethylated cornstarch solution to achieve a loading of 3.3 wt. % starch. The surface sized support was calendered to an apparent density of 1.04 gm/cc. The following laminated photographic base was prepared by extrusion laminating a biaxially oriented sheets with voids to the emulsion side of the photographic grade cellulose paper base and one biaxially oriented sheets to the backside of the photographic grade cellulose paper base.

Top biaxially oriented, microvoided sheet utilized in sample 2 (invention):

A composite sheet consisting of 5 layers identified as L1, L2, L3, L4, and L5. L1 was a thin colored polyethylene layer on the top of the biaxially oriented sheet to which the photosensitive silver halide layer was attached. L1 contained 0.12% of pigment blue 60 to offset the native yellowness of coating format 1. L2 contained 18% of $TiO_2$ and consisted of polypropylene. L3 was a microvoided polypropylene layer that had a compression percentage of 25%. L4 and L5 were solid layers of polypropylene. L6 was an extrusion coated low density polyethylene layer used to laminate the top and bottom biaxially oriented sheets to the paper base. The top sheet (layers L1–L5) was coextruded and biaxially oriented.

The following is the structure of sample 2 (invention):

| Coating Format 1 |
|---|
| Polyethylene exposed surface layer with blue tint (L1) |
| Polypropylene layer containing 28% anatase $TiO_2$ (L2) |
| Polypropylene microvoided layer with 25% compression percentage (L3) |
| Polypropylene layer (L4) |
| Polypropylene layer (L5) |
| Low density polyethylene (adhesive tie layer) |
| Cellulose paper base |
| Low density polyethylene (adhesive tie layer) |
| Biaxially oriented polyolefin sheet |
| Sodium salt of styrene sulfonic acid |

The L3 layer is microvoided and further described in Table 1 where the refractive index and geometrical thickness is shown for measurements made along a single slice through the L3 layer; they do not imply continuous layers; a slice along another location would yield different but approximately the same thickness. The areas with a refractive index of 1 are voids that are filled with air, and the remaining layers are polypropylene. The L3 voided polypropylene has the ability to compress under a load in the thickness direction. The amount of compression is related to the volume of air in the voided structure.

TABLE 1

| Sublayer of L3 | Refractive Index | Thickness, μm |
|---|---|---|
| 1 | 1.49 | 2.54 |
| 2 | 1 | 1.527 |
| 3 | 1.49 | 2.79 |
| 4 | 1 | 1.016 |
| 5 | 1.49 | 1.778 |
| 6 | 1 | 1.016 |
| 7 | 1.49 | 2.286 |
| 8 | 1 | 1.016 |

TABLE 1-continued

| Sublayer of L3 | Refractive Index | Thickness, μm |
|---|---|---|
| 9 | 1.49 | 2.032 |
| 10 | 1 | 0.762 |
| 11 | 1.49 | 2.032 |
| 12 | 1 | 1.016 |
| 13 | 1.49 | 1.778 |
| 14 | 1 | 1.016 |
| 15 | 1.49 | 2.286 |

Description of control support (sample 1):

The control used for this evaluation was a standard polyethylene monolayer coated on each side of a photographic paper base. Approximately 25 g/m$^2$ of a 0.923 density polyethylene that contains 12% anatase $TiO_2$ by weight was melt extruded to the paper base on the topmost side which is directly under the photographic emulsion. On the bottom side, 25 g/m$^2$ of a clear low density polyethylene was melt extruded and adhered to the photographic paper base.

To measure the compression percentage for the invention (sample 2) and the control (sample 1), the compression percentage of the top biaxially oriented, microvoided sheet and a polyethylene monolayer of sample 1 (25 g/m$^2$ of a 0.923 density polyethylene) was measured. By isolating the top sheets for the invention and control, the compression percentage contribution from the paper base was avoided. The top sheet and the monolayer were measured to isolate the effect of the layer under the light sensitive layers. Compression percentage is defined as the percent that a material deforms under a load referenced to when there is no compressive load applied. This can be measured by using an "optical" thickness reading vs. a high pressure caliper reading. The optical thickness is obtained by slicing the photographic element with a microtome to expose the thickness dimension perpendicular to a microscope suitable for making uncompressed thickness readings. A high pressure caliper is hereby defined as a device to measure the thickness as it is compressed between two pads with an area of 0.317 cm$^2$ and a pressure of at least 70 newtons/cm$^2$. The compression percentage is 1 minus the ratio of the high pressure caliper to the optical thickness. The compression percentage results are presented in Table 2 below:

TABLE 2

| Sample Description | "optical" caliper | High Pressure Caliper | Compression % |
|---|---|---|---|
| Sample 1 (control) | 26.0 μm | 25.0 μm | 4% |
| Sample 2 (invention) | 35.8 μm | 27 μm | 25% |

The results from Table 2 show the superior ability of the top biaxially oriented, microvoided sheet to deform at compressive loads above 70 newtons/cm$^2$. The control material, typical of prior art photographic paper, has a low compression percentage compared to the invention, as the cast polyethylene layer did not contain a cushioning layer.

Coating format 1 was utilized to prepare photographic print materials utilizing photographic supports sample 1 and sample 2.

| | Coating Format 1 | Laydown mg/m$^2$ |
|---|---|---|
| Layer 1 | Blue Sensitive Layer | |
| | Gelatin | 1300 |
| | Blue sensitive silver | 200 |
| | Y-1 | 440 |
| | ST-1 | 440 |
| | S-1 | 190 |
| Layer 2 | Interlayer | |
| | Gelatin | 650 |
| | SC-1 | 55 |
| | S-1 | 160 |
| Layer 3 | Green Sensitive | |
| | Gelatin | 1100 |
| | Green sensitive silver | 70 |
| | M-1 | 270 |
| | S-1 | 75 |
| | S-2 | 32 |
| | ST-2 | 20 |
| | ST-3 | 165 |
| | ST-4 | 530 |
| Layer 4 | UV Interlayer | |
| | Gelatin | 635 |
| | UV-1 | 30 |
| | UV-2 | 160 |
| | SC-1 | 50 |
| | S-3 | 30 |
| | S-1 | 30 |
| Layer 5 | Red Sensitive Layer | |
| | Gelatin | 1200 |
| | Red sensitive silver | 170 |
| | C-1 | 365 |
| | S-1 | 360 |
| | UV-2 | 235 |
| | S-4 | 30 |
| | SC-1 | 3 |
| Layer 6 | UV Overcoat | |
| | Gelatin | 440 |
| | UV-1 | 20 |
| | UV-2 | 110 |
| | SC-1 | 30 |
| | S-3 | 20 |
| | S-1 | 20 |
| Layer 7 | SOC | |
| | Gelatin | 490 |
| | SC-1 | 17 |
| | $SiO_2$ | 200 |
| | Surfactant | 2 |

Appendix

Y-1

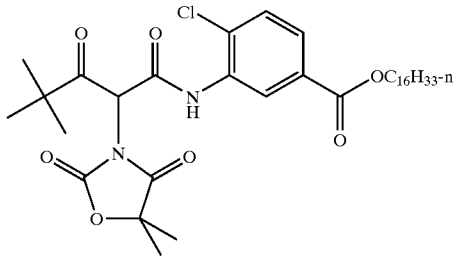

ST-1=N-tert-butylacrylamide/n-butyl acrylate copolymer (50:50)

S-1=dibutyl phthalate

SC-1

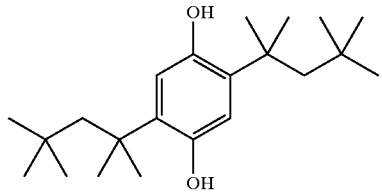

M-1

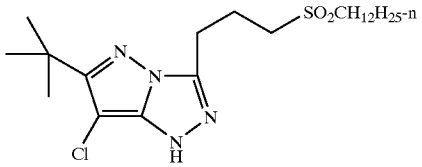

S-2=diundecyl phthalate

ST-2

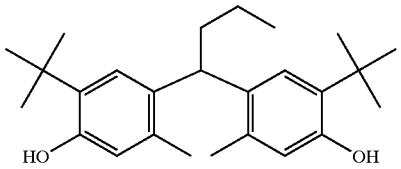

ST-3

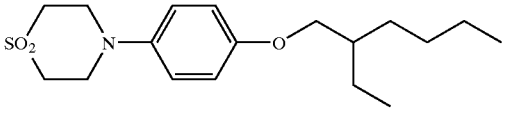

ST-4

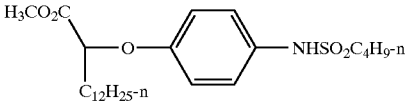

UV-1

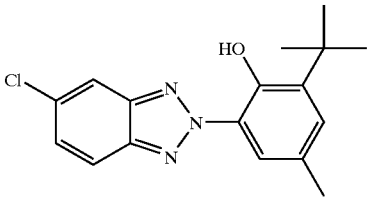

UV-2

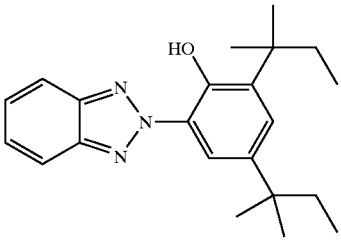

S-3=1,4-Cyclohexyldimethylene bis(2-ethylhexanoate)

C-1

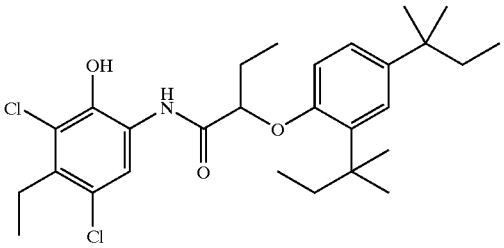

S-4=2-(2-Butoxyethoxy)ethyl acetate

Dye 1

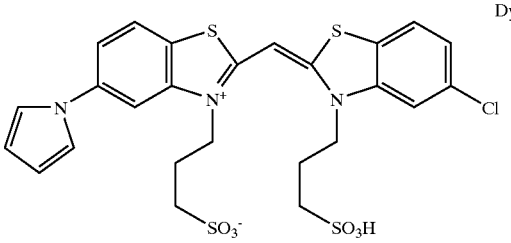

The invention and the control were measured for pressure sensitivity by applying a 206 MPa load using an area of 0.10 $cm^2$ to the coated light sensitive silver halide emulsion, exposing and developing the yellow layer and measuring the density difference with an X-Rite model 310 photographic transmission densitometer between samples which were unloaded and the loaded sample. A 206 MPa compressive load is typical of the compressive load in the slitting process. The preferred change in yellow layer density is less than 0.02 at compressive load of 206 MPa. A 0.04 change in yellow density is perceptually significant and thus undesirable. The data in Table 3 show the yellow density difference between the loaded and unloaded samples of the invention and control.

TABLE 3

| Sample Description | Yellow Density Change |
|---|---|
| Sample 1 (control) | 0.05 |
| Sample 2 (voided) | 0.01 |

The data from Table 3 clearly demonstrate the significant reduction in pressure fog of the yellow layer compared to prior art photographic papers. This result is significant as a yellow density change of 0.05 for the control is perceptually significant and undesirable. The 206 MPa load used in this test is typical of the compressive load applied to the slit edge photographic paper during the slitting operation as rolls of sensitized paper are slit into smaller rolls utilized in photographic processing. A significant reduction pressure sensitivity along the slit edges eliminates the yellow edge common to photographic papers and thus improves the quality of the images.

Further, by incorporating a voided compressive layer under the silver halide imaging layers, more pressure sensitive silver grains can be utilized to improve printing speed of typical silver halide emulsions, which has considerable commercial value. Finally by incorporating a compressive layer under the emulsion, deviations in support thickness caused by lamination ridges were eliminated, thus improving the efficiency of the lamination process.

The invention has been described in detail with particular reference to certain preferred embodiments thereof, but it will be understood that variations and modifications can be effected within the spirit and scope of the invention.

What is claimed is:

1. A photographic element comprising a reflective color print material comprising at least one silver halide containing imaging layer and a foamed cushioning layer comprising a biaxially oriented polyolefin sheet having at least one foamed layer, below said at least one imaging layer having a compression percentage of between 5 and 25%, and wherein the recovery percentage of said biaxially oriented polyolefin sheet is between 50% and 100% of the amount compressed and said photographic element has a base below said cushioning layer.

2. The photographic element of claim 1 wherein said cushioning layer element has a compression of between 20 and 25.

3. The photographic element of claim 1 further comprising a biaxially oriented polyolefin sheet below said base.

4. The photographic element of claim 3 wherein said base comprises paper.

5. The photographic element of claim 1 wherein said biaxially oriented polyolefin sheet comprising said cushioning layer is laminated to paper.

6. The photographic element of claim 5 wherein there is a nonvoided polymer layer between said at least one silver halide containing photographic layer and said cushioning layer.

7. The photographic element of claim 5 where in said cushioning layer has a recovery percentage greater than 90%.

8. The photographic element of claim 6 wherein said nonvoided polymer layer comprises polyethylene.

9. The photographic element of claim 1 wherein said at least one silver halide layer comprises emulsions having an average grain size of greater than 0.30 $\mu$m.

10. The photographic element of claim 1 wherein said cushioned layer is laminated to a base comprising polyester sheet.

11. The photographic element of claim 1 wherein said at least one silver halide layer comprises a yellow layer having an average grain size of greater than 0.60 $\mu$m.

12. The photographic element of claim 1 wherein said cushioning layer comprises an oriented foamed polyolefin sheet with solid layers coextruded on each side.

13. The photographic element of claim 1 wherein said at least one foamed layer has been formed by chemical blowing agents during extrusion.

14. The photographic element of claim 1 wherein the bubble density in said foamed layer is controlled to provide the proper mechanical cushioning properties of said photographic element.

15. The photographic element of claim 1 wherein said at least one foamed layer has been formed by liquids that turn to gas at atmospheric pressure.

* * * * *